US008438975B2

(12) United States Patent
Hofmann

(10) Patent No.: US 8,438,975 B2
(45) Date of Patent: May 14, 2013

(54) PRINTING PRESS

(75) Inventor: Rainer Hofmann, Hirschhorn (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 478 days.

(21) Appl. No.: 12/406,250

(22) Filed: Mar. 18, 2009

(65) Prior Publication Data

US 2009/0255429 A1 Oct. 15, 2009

(30) Foreign Application Priority Data

Mar. 18, 2008 (DE) ..... 10 2008 014 756

(51) Int. Cl.
*B41F 27/12* (2006.01)

(52) U.S. Cl.
USPC ..... 101/477; 101/382.1

(58) Field of Classification Search ..... 101/382.1, 101/383, 415.1, 477
See application file for complete search history.

(56) References Cited

U.S. PATENT DOCUMENTS

| | | | | |
|---|---|---|---|---|
| 4,711,172 A | | 12/1987 | Capdebosc | |
| 5,074,212 A | * | 12/1991 | Kobler et al. | 101/477 |
| 5,209,159 A | | 5/1993 | Asanuma | |
| 5,289,775 A | * | 3/1994 | Spiegel et al. | 101/477 |
| 5,537,926 A | * | 7/1996 | Beisel et al. | 101/477 |
| 5,555,803 A | | 9/1996 | Holm | |
| 5,595,119 A | * | 1/1997 | Hada et al. | 101/477 |
| 5,619,926 A | | 4/1997 | Engelmann et al. | |
| 6,393,986 B1 | | 5/2002 | Tobe et al. | |
| 6,450,096 B1 | * | 9/2002 | Koppelkamm et al. | 101/477 |
| 6,691,619 B2 | * | 2/2004 | Saito et al. | 101/477 |

FOREIGN PATENT DOCUMENTS

| | | | |
|---|---|---|---|
| DE | 4219705 | A1 | 12/1992 |
| DE | 4421437 | A1 | 10/1994 |
| DE | 4322027 | A1 | 1/1995 |
| DE | 10122179 | A1 | 11/2001 |
| DE | 60029400 | T2 | 7/2007 |
| DE | 102006056831 | B4 | 6/2008 |
| EP | 0706884 | A1 | 4/1996 |
| GB | 2279909 | A | 1/1995 |

OTHER PUBLICATIONS

German Search Report dated Nov. 26, 2008.

* cited by examiner

*Primary Examiner* — Ren Yan
(74) *Attorney, Agent, or Firm* — Laurence A. Greenberg; Werner H. Stemer; Ralph E. Locher

(57) ABSTRACT

A printing press includes an apparatus for handling or manipulating varnishing plates or printing plates, having a plate feed channel which is at least temporarily disposed in a plate feed position for feeding a varnishing or printing plate out of the plate feed channel to a plate cylinder. A seat or step surface for an operator is disposed above the plate feed channel.

7 Claims, 2 Drawing Sheets

PRINTING PRESS

CROSS-REFERENCE TO RELATED APPLICATION

This application claims the priority, under 35 U.S.C. §119, of German Patent Application DE 10 2008 014 756.7, filed Mar. 18, 2008; the prior application is herewith incorporated by reference in its entirety.

BACKGROUND OF THE INVENTION

Field of the Invention

The present invention relates to a printing press, including an apparatus for handling or manipulating varnishing plates or printing plates, having a plate feed channel which is disposed at least temporarily in a plate feed position for feeding a varnishing or printing plate out of the plate feed channel to a plate cylinder.

German Published, Non-Prosecuted Patent Application DE 43 22 027 A1, corresponding to UK Patent Application GB 2 279 909 A, describes an apparatus for automatically changing printing plates. That apparatus is preferably provided for small format web-fed rotary printing presses. The apparatus includes a plate feed device which can be pivoted into a position in which the plate feed device is oriented substantially horizontally. That apparatus is unsuitable for use in sheet-fed printing presses. Sheet-fed printing presses frequently have a varnishing unit with a varnishing plate which is changed manually. In practice, an operator stands next to the varnishing unit during the plate change which, however, is unfavorable ergonomically. Changing large format plates is particularly uncomfortable. For that purpose, two operators are required to hold the plates from both machine sides while standing next to the varnishing unit on the right and left.

SUMMARY OF THE INVENTION

It is accordingly an object of the invention to provide a printing press, which overcomes the hereinafore-mentioned disadvantages of the heretofore-known devices of this general type and which has an ergonomically favorable configuration with regard to a manual plate change.

With the foregoing and other objects in view there is provided, in accordance with the invention, a printing press, comprising a plate cylinder, and an apparatus for handling varnishing plates or printing plates. The apparatus has a plate feed channel at least temporarily disposed in a plate feed position for feeding a varnishing or printing plate out of the plate feed channel to the plate cylinder. A seat or step surface for an operator is disposed above the plate feed channel.

In conjunction with the present invention, a varnishing plate is also understood to be a rubber blanket which is used for varnishing, a so-called varnishing blanket. A flexographic printing plate can also be used as a varnishing plate.

The plate feed channel can be situated permanently in the plate feed position, in which the latter is a fixed position.

In the printing press according to the invention, a surface on which the printer can stand, kneel or preferably sit while feeding the plate to the plate cylinder and while inserting the front edge of the plate into a plate clamping device of the plate cylinder, is disposed above the plate feed channel. As a result, a comfortable posture and a satisfactory ability to observe the plate change operation are made possible for the printer, and only a single operator is required for plate handling, even in the case of large plate formats.

The plate feed channel and the seat or step surface lie completely or at least partially on a common vertical alignment line. In the last-mentioned case, the plate feed channel and the seat or step surface are offset somewhat in the horizontal direction with respect to one another, but only to such an extent that overlapping between them remains ensured.

In accordance with another feature of the invention, the plate feed channel is oriented substantially horizontally when feeding the varnishing or printing plate to the plate cylinder. Accordingly, the plate feed direction extends substantially horizontally.

In accordance with a further feature of the invention, the plate feed channel is mounted in such a way that it can be adjusted from another position, in which the plate feed channel can be oriented, for example, substantially vertically, into the plate feed position. In this embodiment, the plate feed position is therefore not a fixed position, but rather one of a plurality, for example two, optionally settable positions of the plate feed channel.

In accordance with an added feature of the invention, the plate feed channel is a constituent part of a plate feed device and an outer surface of the plate feed device forms a seat or step surface. For example, the plate feed channel can be formed by a double row of small transport rollers, between which the varnishing or printing plate is transported, and the small transport rollers can be integrated into a substantially box-shaped housing. In this case, the outer surface of one wall of the housing can form the seat or step surface. This wall can, for example, include a closed sheet metal surface, a perforated metal sheet or a multiplicity of rods or wires which are joined together to form a grill or grid.

In accordance with an additional feature of the invention, the plate feed device is of sufficiently stable configuration to absorb the weight of at least one operator who is standing, kneeling or sitting on the plate feed device. For example, if a joint were present, about which the plate feed device was mounted in such a way that it could pivot from the plate feed position into the other position and back again, and which joint carried one end of the plate feed device when it was situated in the plate feed position, it would have to be ensured that the joint was also capable of absorbing the increase in the bearing force caused by the weight of the operator. A joint pin of the joint would have to be of correspondingly thick configuration. If the outer surface of the housing of the plate feed device were present in such a way that it was configured as a grid or grill, struts would possibly have to be provided which would be disposed under the grid or grill to support and stabilize them on the rear side and which would ensure the dimensional stability of the grid or grill.

In accordance with yet another feature of the invention, the seat or step surface is mounted in such a way that it can be adjusted into an active or working position, in which the seat or step surface extends substantially in the horizontal plane. In this case, the seat or step surface can optionally be adjusted from another position which is unsuitable for the operator to sit or stand on the seat or step surface into the active or working position which is suitable for the operator to sit or stand on the seat or step surface, and back again. In a deviation from this embodiment, it is also possible, however, for the working position of the seat or step surface to be a fixed position, in which the seat or step surface is situated permanently. However, the variant which relates to the adjustability of the seat or step surface is given preference over the variant which relates to the fixed position.

In accordance with yet a further feature of the invention, the seat or step surface and the plate feed channel together form a unit which is mounted adjustably in such a way that the seat or step surface is adjusted together with the plate feed channel by an adjustment of the unit, with the seat or step surface being adjusted into its working position and at the same time the plate feed channel being adjusted into its plate feed position. For example, the unit can be adjusted from another position into a horizontal position, in which the plate feed channel and the seat or step surface are situated in the positions which are required for their use (plate feed position, working position).

In accordance with yet an added feature of the invention, the plate feed channel is mounted in such a way that it can be adjusted into a loading position, in which at least one varnishing or printing plate can be inserted into the plate feed channel and in which the plate feed channel is oriented substantially vertically. Accordingly, the loading direction extends substantially vertically. The plate feed channel can be configured in such a way that it can be loaded in each case with only a single varnishing or printing plate or can have a first shaft for receiving a varnishing or printing plate which is provided for the next print job and a second shaft for receiving a varnishing or printing plate which is intended for the print job after the next. The plate feed channel can also be configured as a supply storage device for a multiplicity of varnishing or printing plates which are required for a plurality of subsequent jobs. Moreover, one or more so-called plate supports which is/are situated between the varnishing or printing plate and the plate cylinder when the former is clamped on the plate cylinder, can also be stored in the plate feed channel.

In accordance with yet an additional feature of the invention, the seat or step surface extends substantially in the vertical plane when the plate feed channel is adjusted into the loading position. During loading of the plate feed channel with the varnishing or printing plate, the operator can stand next to the varnishing or printing unit without affecting his or her comfort. It is not necessarily required to use the seat or step surface for this purpose.

In accordance with again another feature of the invention, the seat or step surface is mounted in such a way that it can be adjusted out of its working position into a waiting position, in which the seat or step surface is oriented substantially vertically. The seat or step surface is situated in the waiting position when at the same time the plate feed channel is situated in the loading position.

In accordance with again a further feature of the invention, the seat or step surface is a constituent part of a protective device for closing and opening an opening which is situated in a wall or between two walls of a varnishing or printing unit. In this case, the seat or step surface and the protective device can together form a unit which is mounted adjustably in such a way that the seat or step surface is adjusted into its passive or waiting position as a result of an adjustment of the unit and at the same time the protective device is adjusted into a protective or closure position, in which the protective device closes the opening.

In the case of the integration of the seat or step surface into a multifunctional unit, it is possible for the unit to combine the two functions of the seat or step surface and of the plate feed channel within itself or to combine the two functions of the seat or step surface and of the protective device within itself or preferably to combine the three functions of the seat or step surface, of the plate feed channel and of the protective device within itself.

In the case where the multifunctional unit combines the functions of the seat or step surface and at least of the protective device within itself, the seat or step surface can be formed by a surface of the protective device which faces the closed opening when the protective device is closed, and it is to be ensured that the protective device is configured with sufficient stability to carry the weight of the at least one operator.

In accordance with again an added feature of the invention, the protective device is mounted in such a way that it can be adjusted optionally into a protective position for closing the varnishing or printing unit and into an open position. The protective device and the step or seat surface which is disposed on the former are oriented substantially vertically in the protective position and are oriented substantially horizontally in the open position.

In accordance with a concomitant feature of the invention, the multifunctional unit and the protective device can be adjusted by pivoting, for example if the protective device is configured as a protective flap which is mounted in such a way that it can be pivoted about a joint.

Other features which are considered as characteristic for the invention are set forth in the appended claims.

Although the invention is illustrated and described herein as embodied in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
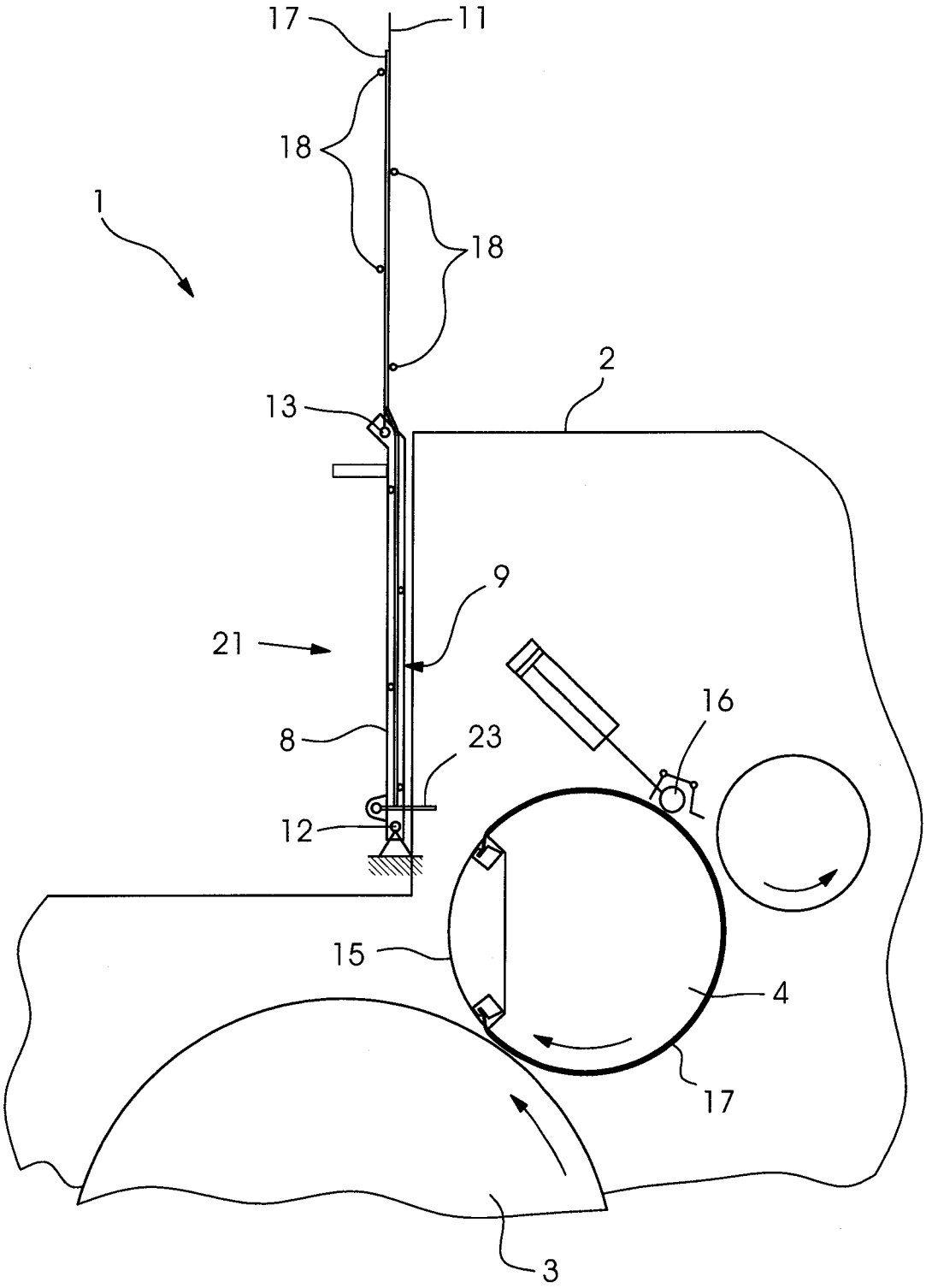
FIG. 1 is a fragmentary, diagrammatic, cross-sectional view of a varnishing unit having a seat which is pivoted into an upper position, in which the seat acts as a protective flap.
Figure 2:
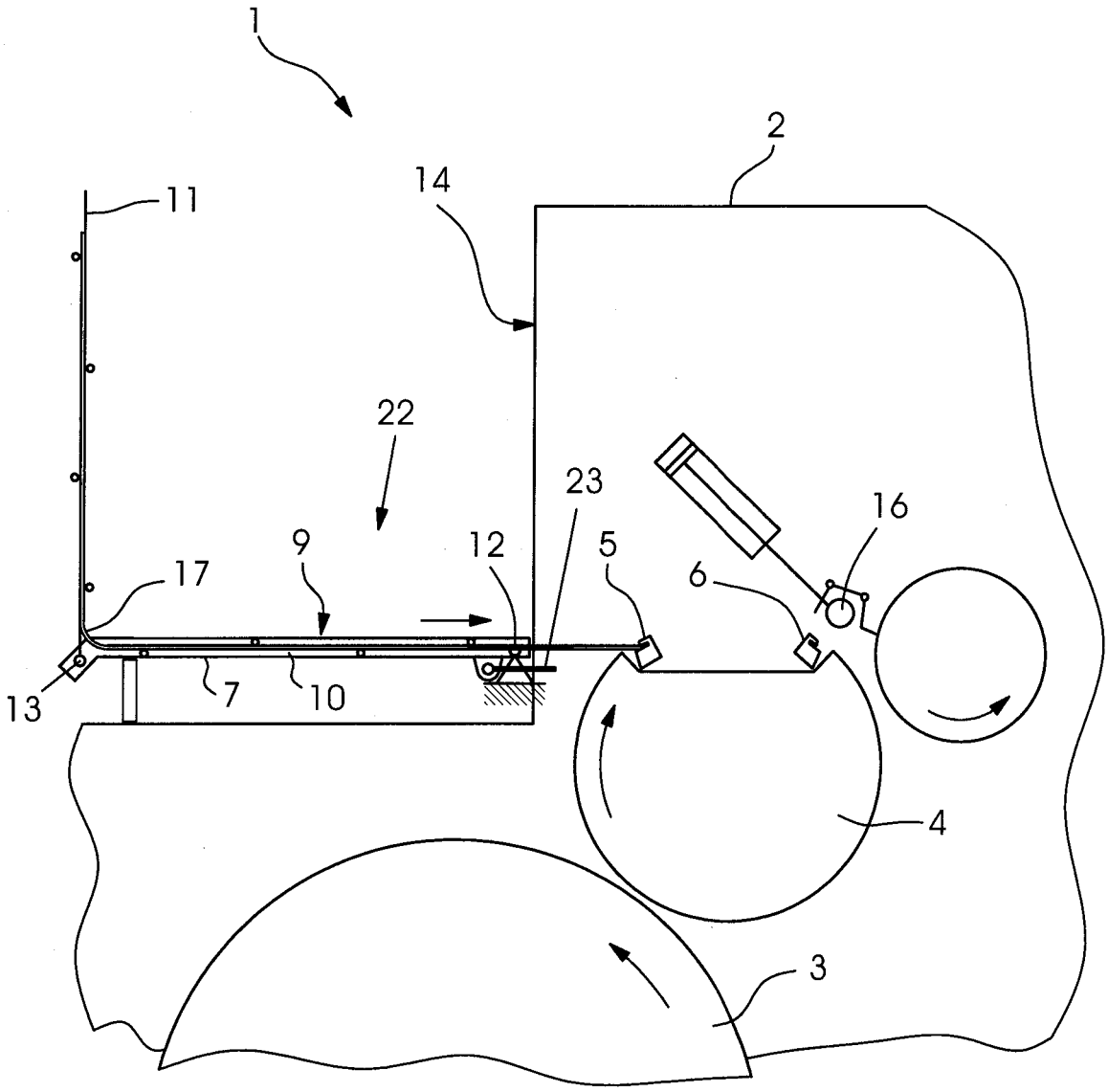
FIG. 2 is a fragmentary, cross-sectional view of the varnishing unit of FIG. 1, with the seat being pivoted into a lower position, in which the seat acts as a plate feed channel.

Referring now in detail to FIGS. 1 and 2 of the drawings as a whole, there is seen a printing press 1. The fragmentary views show a varnishing unit 2 of the printing press 1. The varnishing unit 2 includes an impression cylinder 3 for transporting printed sheets. Moreover, the varnishing unit 2 includes a plate cylinder 4 which interacts directly with the impression cylinder 3.

The plate cylinder 4 is a so-called varnishing cylinder which applies varnish or a coating liquid that is comparable therewith to the printed sheet. The plate cylinder 4 is equipped with a front holding device 5 and a rear holding device 6. The front holding device 5 serves to fixedly hold a front plate end and the rear holding device 6 serves to fixedly hold a rear plate end, of a varnishing plate 17 which can be clamped on the plate cylinder 4, as seen in a cylinder rotational direction. The holding devices 5, 6 are clamping devices, in which plate edges are clamped. The varnishing plate 17 can be a flexographic printing form and can also be a rubber blanket, a so-called varnishing blanket.

Furthermore, the varnishing unit 2 includes a unit which is mounted in such a way that it can be adjusted into a first position 21 (see FIG. 1) and into a second position 22 (see FIG. 2). The unit combines different functions within itself, namely the function of a plate feed device 7, the function of a protective device 8 and the function of a seat surface 9. The unit (that is to say, the plate feed device 7, the protective device 8 and the seat surface 9) can be adjusted optionally into the positions 21, 22 by being pivoted about a joint 12.

In order to configure the unit as the plate feed device 7, a plate feed channel 10 and a holding apparatus 11 are integrated into the unit. The holding apparatus 11 is connected to the plate feed channel 10 in a pivotably movable manner through a joint 13. The plate feed device 7 is equipped with transport rollers 18 which guide the varnishing plate 17 during its transport to the plate cylinder 4. Instead of or in addition to the transport rollers 18, transport elements of a different construction can also be provided, for example so-called sliding pads.

The varnishing unit 2 has a housing which includes two side walls, between which the plate cylinder 4 is mounted. The two side walls are disposed behind one another in a direction perpendicular to the drawing plane of FIGS. 1 and 2, with the result that only the side wall which lies at the front can be seen in the drawing and the side wall which lies at the back is hidden by the front side wall. A housing opening 14, which extends in a plane perpendicular to the drawing plane of FIGS. 1 and 2, is situated between the two side walls.

The plate cylinder 4 has a cylinder channel, in which the holding devices 5, 6 are seated. There is a channel cover 15 which can be placed onto the plate cylinder 4, in order to close the plate cylinder 4. FIG. 1 shows the plate cylinder 4 with a varnishing plate 17 clamped thereto and the channel cover 15 placed thereon. In contrast, in FIG. 2, the varnishing plate 17 is not yet clamped to the plate cylinder 4 and the channel cover 15 is not yet placed onto the plate cylinder 4.

Furthermore, the drawing shows a pressure roller 16 which presses the varnishing plate 17 against the plate cylinder 4 when the varnishing plate 17 is laid on the plate cylinder 4.

The system which is shown functions as follows: during printing operation, the unit is adjusted into the first position 21, in which the protective device 8 covers the housing opening 14, as a result of which an operator cannot reach through the housing opening 14 into the varnishing unit 2. An unauthorized intervention of this type would otherwise entail a risk of injury. An electric protective switch or another sensor can be provided which checks for the presence of the protective device 8 in the first position 21 and interrupts printing operation if the protective device 8 is adjusted from the first position 21 into the second position 22 during printing operation.

In order for it to be possible to insert the varnishing plate 17 into the plate feed device 7 in an improved manner during printing operation, the holding apparatus 11 can be pivoted about the joint 13 by approximately 180° from its position (not shown in the drawing), in which the holding apparatus 11 is situated on that side of the plate feed channel 10 which faces away from the housing opening 14, into another position, in which the holding apparatus 11 and its row of transport rollers is aligned with the plate feed channel 10 and its row of transport rollers, as shown in FIG. 1.

In order to ensure that, when the plate feed device 7 is situated in the first position 21, the varnishing plate 17 which is inserted into the plate feed device 7 does not slide out of the lower end of the plate feed channel 10 and does not pass into the printing press 1 which is running during printing operation, there can be a closure device 23 for temporarily closing the lower end. The closure device 23 can be coupled mechanically to the plate feed device 7 in such a way that, when the plate feed device 7 is pivoted out of the first position 21 into the second position 22, the closure device 23 is opened automatically.

The holding apparatus 11 and the plate feed channel 10 are coupled to one another using gear technology in such a way that, during the movement of the plate feed device 7 out of the first position 21 into the second position 22, the holding apparatus 11 is pivoted out of its position which is aligned with the plate feed channel 10 (see FIG. 1) into a position which is angled with respect to the plate feed channel 10 (see FIG. 2). This pivoting about the joint 13 can take place automatically by mechanical coupling of the holding apparatus 11 to the plate feed channel 10 during pivoting of the plate feed channel 10 or can be carried out by the operator in the form of an additional operation.

Since the plate feed channel 10 is dimensioned in the plate advance direction in such a way that the plate feed channel 10 is shorter than the varnishing plate 17, the front end of the varnishing plate 17 is situated in the region of the plate feed channel 10 when the varnishing plate 17 is stored in the plate feed device 7, and the rear end of the varnishing plate 17 is situated in the region of the holding apparatus 11, as shown in FIG. 1. As a consequence, the stored varnishing plate 17 is deformed reversibly in the case of the movement of the holding apparatus 11 which takes place relative to the plate feed channel 10. In other words, the flexible varnishing plate 17 is bent out of its elongated position shown in FIG. 1 into its angular position shown in FIG. 2. In order to ensure that the varnishing plate 17 is bent gently, those transport rollers 18 of the plate feed channel 10 and of the holding apparatus 11 which are adjacent the joint 13 are disposed at a sufficiently great spacing, as a result of which the bending point of the varnishing plate 17 has a sufficiently large radius of curvature.

If the unit is situated in the second position 22, the seat surface 9 and the plate feed channel 10 are oriented horizontally. The operator can therefore sit on the seat surface 9, in order to pull the varnishing plate 17 out of the plate feed channel 10 which is situated below the operator and to insert the front edge of the varnishing plate 17 into the front holding device 5. Afterward, the operator who is sitting on the seat surface 9 of the plate feed device 7 or the protective device 8 can close the holding device 5, with the result that the varnishing plate 17 is clamped firmly therein.

A keyboard (not shown in the drawing) is disposed next to the housing opening 14. Through actuation of the keyboard, the operator can set the plate cylinder 4 in very slow rotation in a so-called jogging operation or creeping or crawling gear. The varnishing plate 17 is pulled completely out of the plate feed device 7 by the slowly rotating plate cylinder 4, and the varnishing plate 17 is "ironed" onto the circumferential surface of the plate cylinder 4 in close contact with the latter by the pressure roll 16 which is thrown onto the plate cylinder 4.

After an almost complete revolution of the plate cylinder 4, its rotation is stopped, as a result of which the operator can firmly clamp the rear edge of the varnishing plate 17 in the rear holding device 6 and can place the channel cover 15 on the plate cylinder 4.

Afterward, the operator leaves the seat surface and pivots the unit out of the second position 22 back into the first position 21 , with the result that the housing opening 14 is closed again by the protective device 8, with the seat surface 9 pointing toward the housing opening 14. Afterward, printing operation can be recommenced.

The system which is described herein has the advantage that the operator can sit in an ergonomically comparatively favorable posture on the seat surface 9 while handling the varnishing plate 17. The legs of the operator hang over the seat surface 9 to the side and the upper body of the operator faces the housing opening 14 while undergoing only slight twisting.

The invention claimed is:

1. A printing press, comprising:

a housing having an opening formed therein;

a plate cylinder;

an apparatus for handling varnishing plates or printing plates, said apparatus having a plate feed channel at least temporarily disposed in a plate feed position for feeding a varnishing or printing plate out of said plate feed channel to said plate cylinder;

a seat or step surface for an operator, said seat or step surface formed by an outer surface of said plate feed channel;

said seat or step surface being adjustable and configured to be at least temporarily disposed in a waiting position, in which said seat or step surface is oriented substantially vertically and points to said housing opening for a period of time and in a working position, in which said seat or step surface is oriented substantially horizontally for a period of time; and said seat or step surface being configured to absorb the weight of at least one operator standing, kneeling or sitting with a comfortable posture on said seat or step surface in said working position while handling the varnishing plates or printing plates or observing a plate change operation.

2. The printing press according to claim 1, wherein said plate feed channel is oriented substantially horizontally in said plate feed position.

3. The printing press according to claim 1, wherein said plate feed channel is configured to be adjusted into said plate feed position.

4. The printing press according to claim 1, wherein said apparatus has sufficient stability to carry the weight of the operator.

5. The printing press according to claim 1, wherein said seat or step surface and said plate feed channel together form an adjustably mounted unit configured for adjusting said seat or step surface into said working position by an adjustment of said unit and simultaneous adjustment of said plate feed channel into said plate feed position.

6. The printing press according to claim 1, wherein said seat or step surface is a component part of a protective device for closing and opening a varnishing or printing unit.

7. The printing press according to claim 6, wherein said protective device is mounted pivotably.

* * * * *